US006337616B1

(12) United States Patent
Sato et al.

(10) Patent No.: US 6,337,616 B1
(45) Date of Patent: Jan. 8, 2002

(54) IGNITION COIL FOR INTERNAL-COMBUSTION ENGINE

(75) Inventors: Takanori Sato; Ryozo Takeuchi, both of Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/471,267

(22) Filed: Dec. 23, 1999

(30) Foreign Application Priority Data

Dec. 24, 1998 (JP) ..... 10-366322

(51) Int. Cl.[7] ..... H01F 27/02

(52) U.S. Cl. ..... 336/90; 336/234; 336/96; 336/9

(58) Field of Search ..... 336/234, 96, 90, 336/110

(56) References Cited

FOREIGN PATENT DOCUMENTS

| | | | |
|---|---|---|---|
| JP | 08093616 | * | 4/1996 |
| JP | 09007861 | * | 1/1997 |
| JP | 09017662 | * | 1/1997 |
| JP | 09167709 | * | 6/1997 |

* cited by examiner

*Primary Examiner*—Anh Mai
(74) *Attorney, Agent, or Firm*—Crowell & Moring LLP

(57) ABSTRACT

An ignition coil for an internal-combustion engine has satisfactory electrical insulation capacity and is excellent in reliability and durability. The ignition coil for an internal-combustion engine comprises a primary bobbin on which a primary coil is wound, a secondary bobbin on which a secondary coil is wound, and a center core. The area of a cross section of the center core perpendicular to an axis of the coils at a position on the inner side of the opposite ends of the center core is a maximum.

8 Claims, 15 Drawing Sheets

IGNITION COIL FOR INTERNAL-COMBUSTION ENGINE

BACKGROUND OF THE INVENTION

The present invention relates to an ignition coil for an internal-combustion engine and, more particularly, to an ignition coil for an internal-combustion engine, capable of being partly or entirely set in a plug hole formed in the internal-combustion engine.

The sectional area of a center core included in an ignition coil for an internal-combustion engine, capable of being set in a plug hole of the internal-combustion engine is limited by the diameter of the plug hole. The magnitude of the magnetic energy, i.e., the discharge energy, of the ignition coil is substantially proportional to the sectional area of the core. Ignition coils proposed in, for example, Japanese Patent Laid-open Nos. Hei 4-87311 and 9-167709 employ a center core having a substantially circular cross section. An ignition coil proposed in, for example, Japanese Utility Model Laid-open No. Hei 1-120314 (U.S. Pat. No. 4,893,105) employs a center core tapering from the side of a primary coil toward the side of a secondary coil.

SUMMARY OF THE INVENTION

Since the diameter of, the plug hole places a restriction on the diameter of the prior art ignition coil, it is difficult to form the insulators in a sufficient diametrical size and hence there is a limit to the enhancement of the durability of the ignition coil through the improvement of insulation capacity.

Accordingly, it is an object of the present invention to provide an ignition coil for an internal-combustion engine, capable of generating a sufficient amount of discharge energy and having improved electrical insulation capacity, and to provide an internal-combustion engine provided with such an ignition coil.

Since there is a limit to the diametrical size of an ignition coil to be set in a plug hole of an internal-combustion engine, the ignition coil is provided separately with a center core and a side core to facilitate insulation. Accordingly, the ignition coil has an open magnetic circuit having a big gap length between the opposite ends of a center core. It was found through the studies of the magnetic characteristics of an ignition coil of an open magnetic circuit type that leakage magnetic flux increases in the vicinities of the opposite ends of the center core, magnetic flux is distributed on the center core so that magnetic flux density decreases from the middle of the center core toward the opposite ends of the center core, and magnetic flux density at the opposite ends of the center core is about ⅓ of that at the middle of the center core.

The present invention is characterized by a center core formed so that the sectional area of sections of portions of the center core on the inner side of the opposite ends of the center core perpendicular to the axis of a coil axis is the greatest. The center core having such a shape prevents the reduction of the magnetic characteristic (magnetic energy) thereof.

The present invention is characterized by a center core having a stepped longitudinal section having a stepped width decreasing stepwise from the middle portion toward the opposite ends of the stepped longitudinal section. Magnetic flux density distribution on the center core having such a stepped longitudinal section is substantially uniform and hence discharge energy, i.e., magnetic energy, is not reduced.

Since the center core having such a stepped longitudinal section provides sufficient spaces in the vicinities of the opposite ends thereof where potential difference is large, the center core and a secondary coil can satisfactorily be insulated from each other, which improves reliability in electrical insulation and durability. Since end portions of the center core have a stepped shape, induction of eddy current can be suppressed, core loss can be reduced and rise in the temperature of the ignition coil can be suppressed.

To prevent the reduction of the magnetic characteristics (magnetic energy) of the center core, it is desirable that the cross-sectional area of the center core reach a maximum in portions on the inner side of the opposite ends of the center core. As shown in FIG. 7 by way of example, if an allowable magnetic energy reduction ratio is 10%, it is desirable that the cross-sectional area of the center core reach a maximum in portions at distances in the range of 20% of the length of the center core from the middle of the center core. It is desirable that the middle portion of the center core have the greatest cross-sectional area to prevent the reduction of the magnetic characteristics (magnetic energy) of the center core.

The magnitude of the magnetic energy of the center core is substantially proportional to the sectional area of the center core. As indicated by a curve for a comparative example in FIG. 7, in an open magnetic circuit having a gap between a center core and a side core as this ignition coil, the effect of the sectional area of the center core is less utilized in portions nearer to the opposite ends of the center core. As indicated by a curve for a first embodiment in FIG. 7, magnetic energy does not decrease even if the sectional area of the core is reduced toward the opposite ends of the center core.

The above and other features of the present invention will be described hereinafter with reference to the accompanying drawings.

DESCRIPTION OF THE PREFERRED EMBODIMENTS

Figure 1:
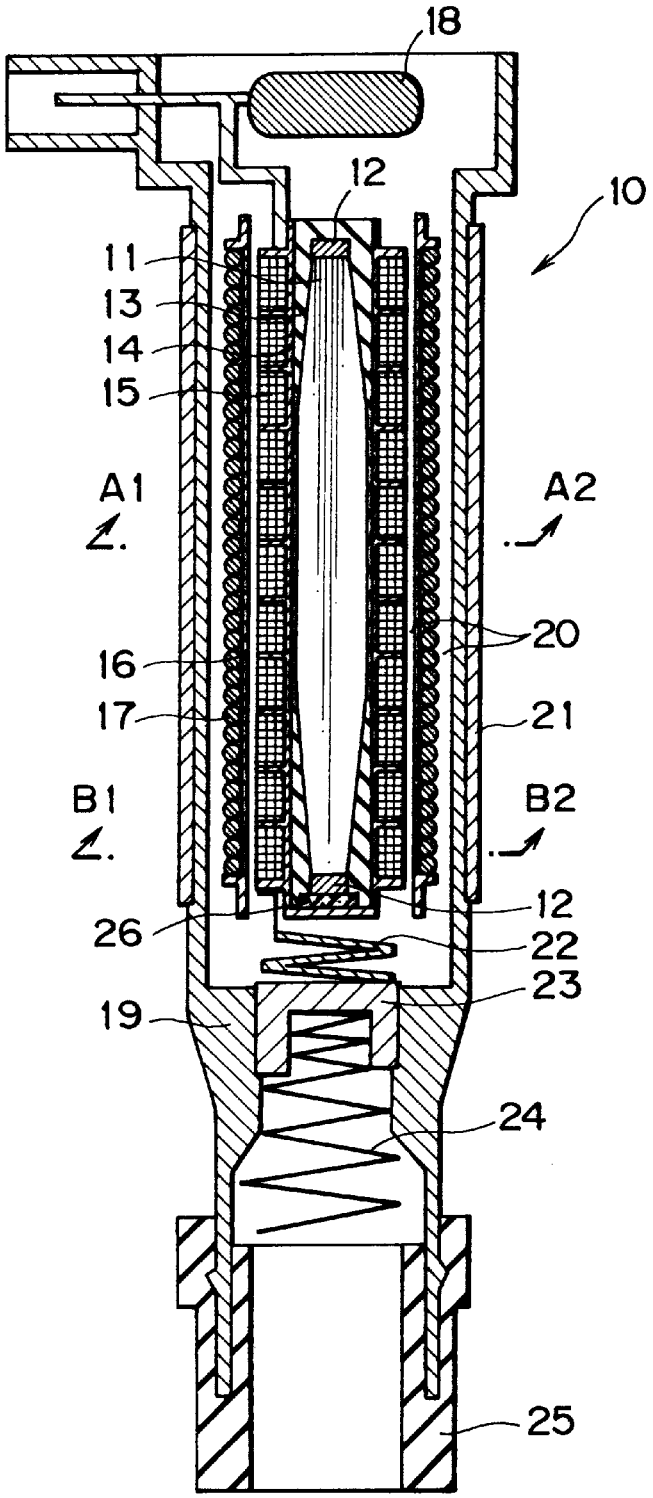
FIG. 1 is a longitudinal sectional view of an ignition coil 10 in a first embodiment according to the present invention for an internal-combustion engine.

Preferred embodiments of the present invention will be described with reference to the accompanying drawings, in which like or corresponding parts are designated by the same reference characters. The following embodiments are only examples and the present invention is not limited thereto.

First Embodiment

Figure 14:
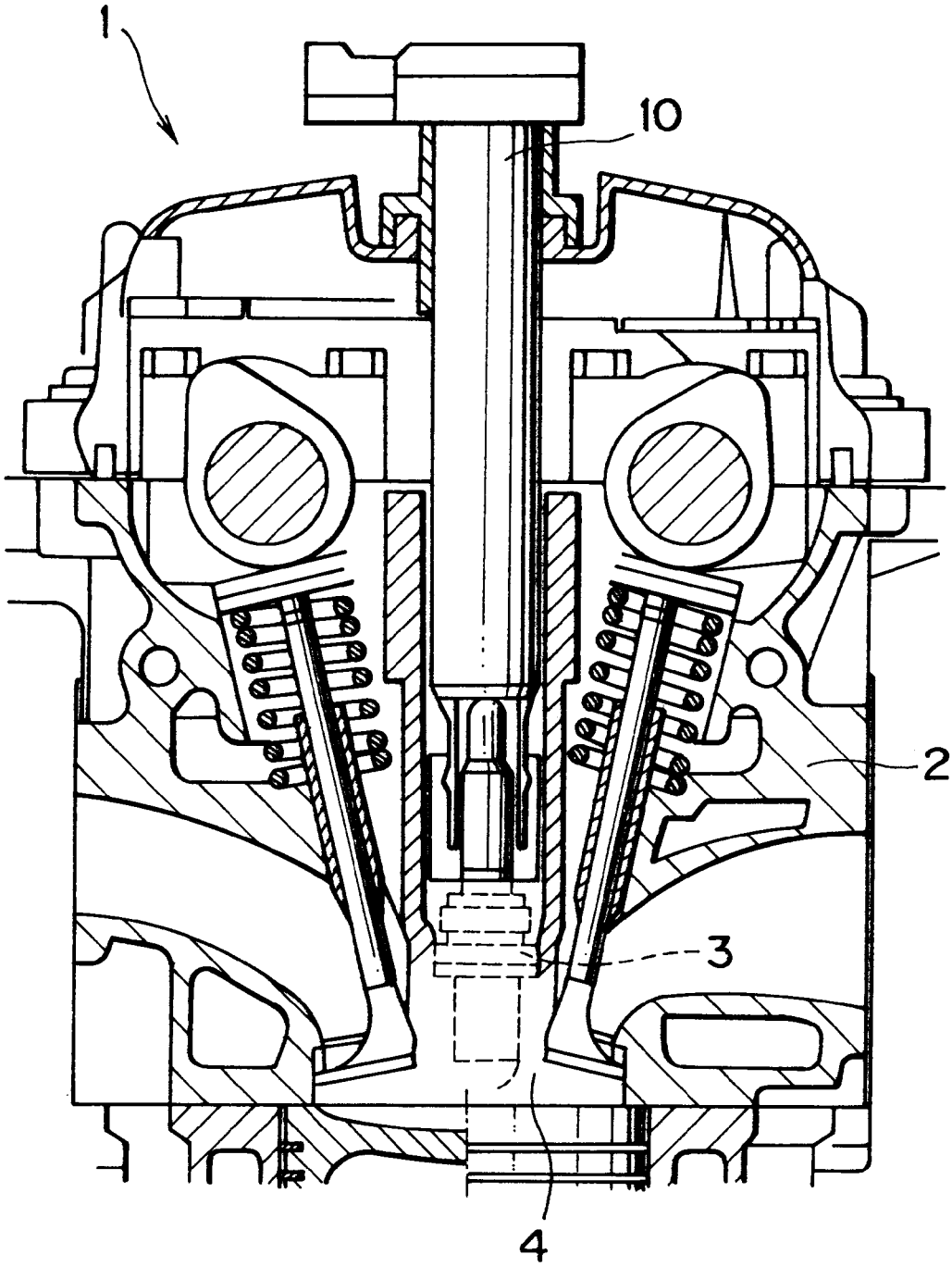
FIG. 14 is sectional view showing the positional relation between an ignition coil in accordance with the present invention and a cylinder head.

Referring to FIG. 14 showing the positional relation between an ignition coil 10 in accordance with the present invention and a cylinder head 2, the ignition coil 10 is partly or entirely set in a hole formed in the cylinder head 2. As shown in FIG. 14, the ignition coil 10 is disposed coaxially with and above a spark plug 3. The spark plug 3 forms sparks in a combustion chamber 4.

FIG. 1 is a longitudinal sectional view of an ignition coil 10 in a first embodiment according to the present invention for an internal-combustion engine. A secondary bobbin 14 is inserted in a primary bobbin 16, and a center core 11 is inserted in the secondary bobbin 14. Permanent magnets 12 are disposed on the opposite ends of the center core 11. The center core 11, the permanent magnets 12 and a side core 21 form a magnetic circuit included in the ignition coil 10. A closed-cell rubber pad 26 is interposed between the permanent magnet 12 and the secondary bobbin 14 to avoid stress concentration in the vicinity of an end of the permanent magnet 12. Each permanent magnet 12 is disposed so that the polarity of a magnetic field created by the permanent magnet 12 is reverse to that of a magnetic field created by the primary coil in the center core 11 when the center core 11 is magnetized; that is, the permanent magnet 12 is disposed so that the respective surfaces of the permanent magnet 12 and the center core 11 adjacent to each other have the same polarity. The permanent magnets 12 are neodymium magnets that creates a magnetic field of a high intensity even if the same have a small thickness, or rare earth magnets, such as rare earth cobalt magnets. The permanent magnets 12 thus disposed add a reverse bias to the magnetizing force of the primary coil to increase magnetic energy. A space between the center core 11 and the secondary bobbin 14 is filled up with an elastic insulating material 13, such as rubber, to avoid stress concentration in the vicinity of the ends of the center core 11. A secondary coil 15 of 10000 to 30000 turns is wound on the secondary bobbin 14. A primary coil 17 is wound on the primary bobbin 16.

An igniter 18, high-tension terminal 23 and such are disposed in a coil case 19. After connecting the primary coil 17 and the secondary coil 15 to those parts, a coil insulating material 20, such as an insulating epoxy resin or an insulating oil, is filled in the coil case through an opening on the side of the igniter 18. A high-tension connecting spring 22, the high-tension terminal 23 and a plug connecting spring 24 are arranged in a lower portion of the coil case 19. A high voltage is applied to a spark plug 3 shown in FIG. 2. A lower end portion of the coil case 19 to be put on the spark plug 3 is insulated from the spark plug 3 with a rubber boot 25.

Figure 2:
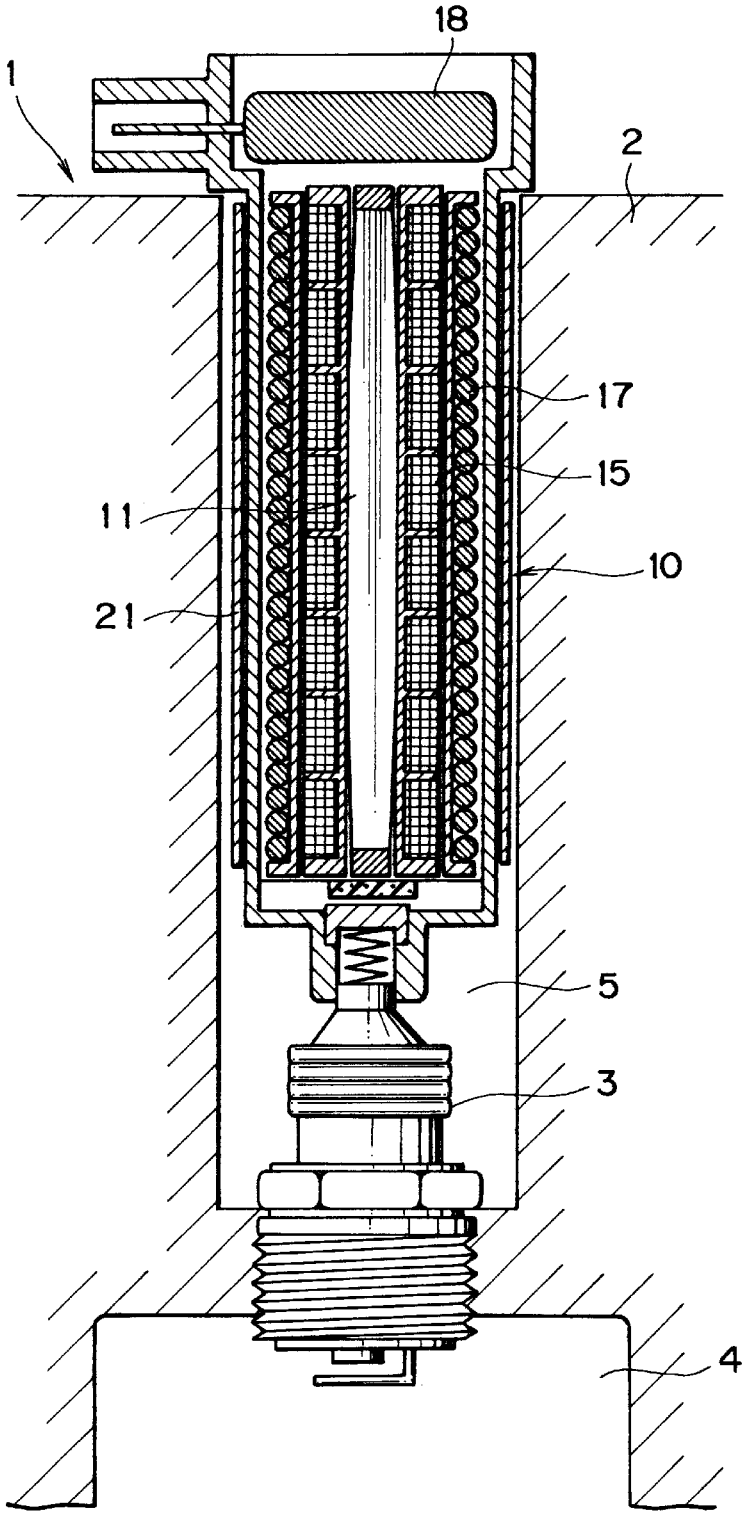
FIG. 2 is a sectional view of an internal-combustion engine provided with the ignition coil shown in FIG. 1.

FIG. 2 shows the ignition coil 10 as inserted in a plug hole 5 formed in the cylinder head 2. FIG. 2 is a sectional view of a portion of the cylinder head 2 for one cylinder. The internal-combustion engine 1 is a straight multiple-cylinder engine provided with a plurality of cylinders in a straight arrangement. The straight multiple-cylinder engine is provided with a plurality of ignition coils which are the same as the ignition coil 10 for the plurality of cylinders.

The ignition coil 10 is connected to the spark plug 3 of the internal-combustion engine 1. The igniter 18 cuts a primary current flowing through the primary coil 17 intermittently. Consequently, a high voltage in the range of 30 to 40 kV is generated in the secondary coil 15 and the high voltage is applied to the spark plug 13 to ignite a compressed mixture in the combustion chamber 4 by forming sparks between the electrodes of the spark plug 3.

Figure 3:
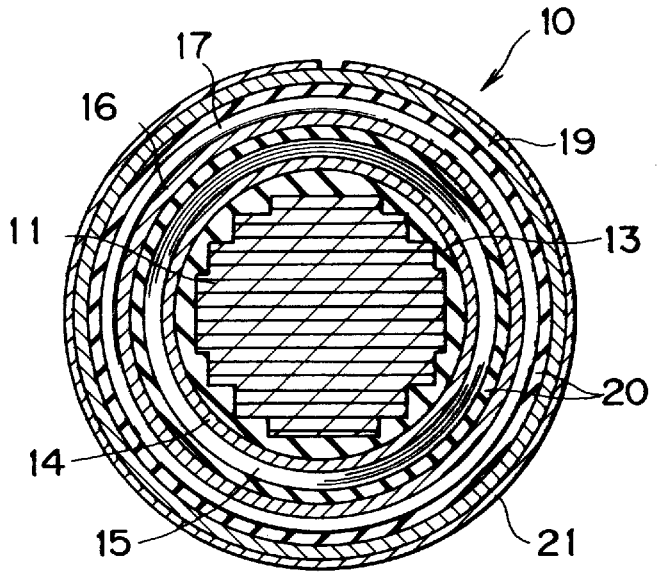
FIG. 3 is a sectional view taken on line A1–A2 in FIG. 1.
Figure 4:
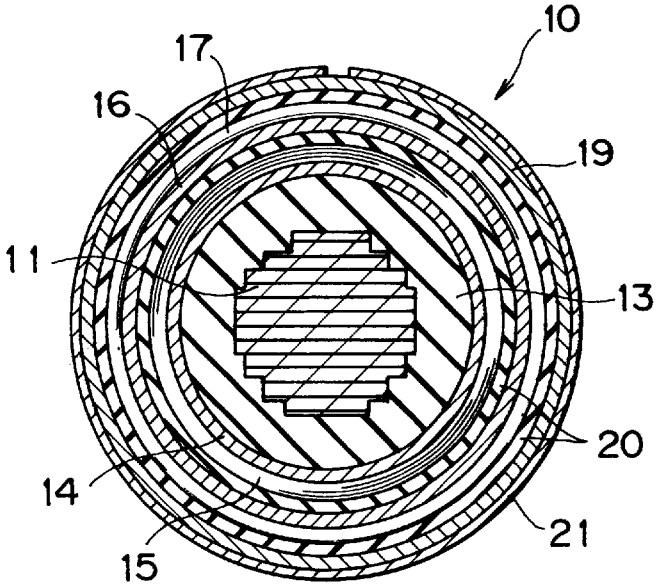
FIG. 4 is a sectional view taken on line B1–B2 in FIG. 1.
Figure 5:
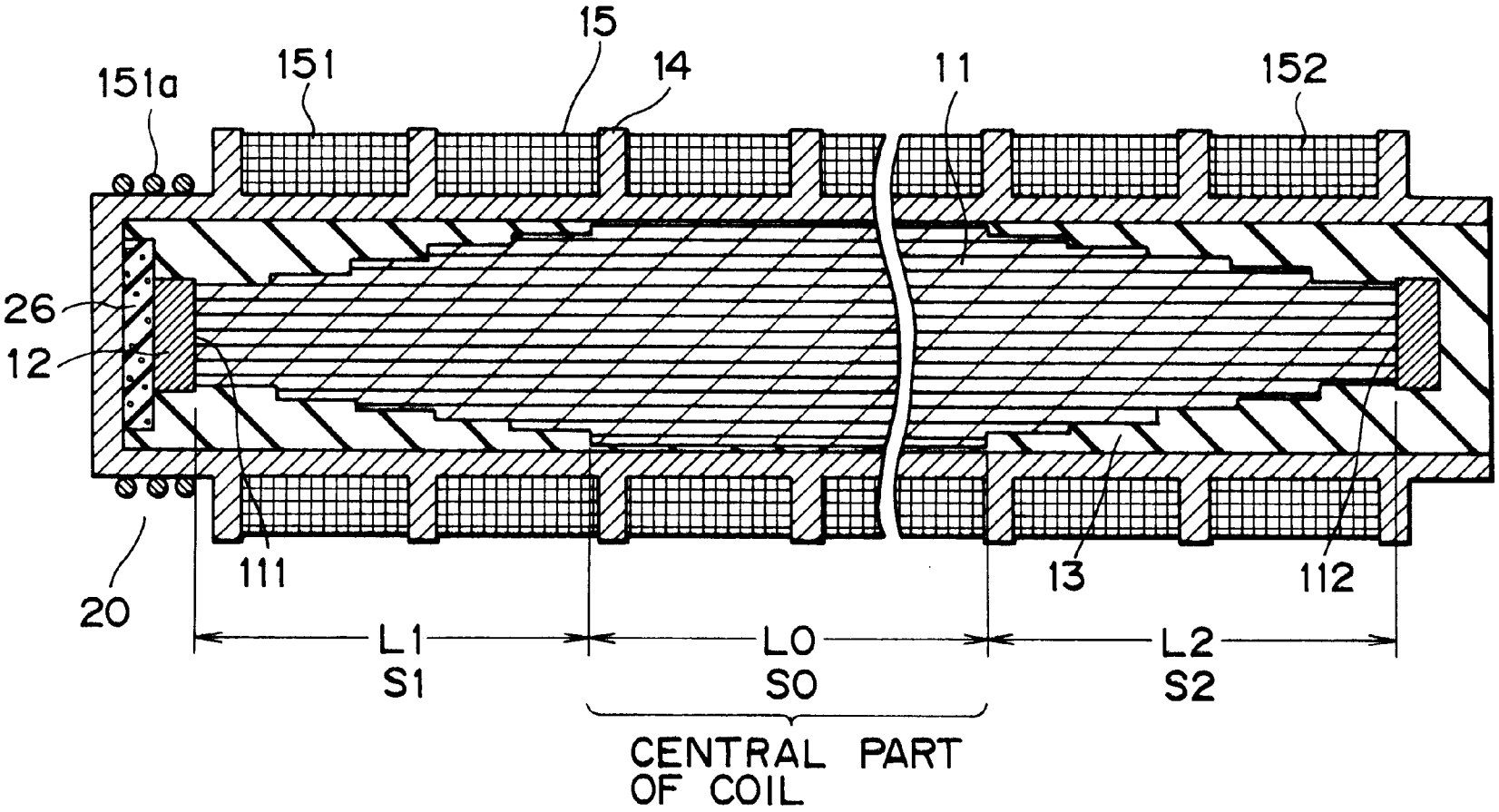
FIG. 5 is an enlarged longitudinal sectional view of the ignition coil shown in FIG. 1.

FIG. 3 is a sectional view of a middle portion of the ignition coil 10 taken on line A1–A2 in FIG. 1, FIG. 4 is a sectional view of an end portion of the ignition coil 10 taken on line B1–B2 in FIG. 1 and FIG. 5 is an enlarged longitudinal sectional view of the center core 11 and the secondary coil 15 of the ignition coil shown in FIG. 1. The center core 11 has a high-tension end 111 and a low-tension end 112, which will sometimes be referred to as "opposite ends". The permanent magnets 12 are attached to the opposite ends 111 and 112 of the center core 11, respectively. The closed-cell rubber pad 26 is interposed between the permanent magnet 12 on the high-tension end 111 and the bottom wall of the secondary bobbin 14. A space between a portion of the center core 11 on the side of the low-tension end 112 and the secondary bobbin is filed up with the elastic insulating material 13, such as rubber. The secondary coil 15 is wound in divisions on the secondary bobbin 14. An end of the secondary coil 15 on the high-tension side will be referred to as "high-tension side secondary coil end 151". A secondary coil binding part 151*a* is formed near the high-tension side secondary coil end 151. The diameter of the center core 11 is a maximum in a middle portion of the center core 11 and decreases toward the opposite ends of the center core 11. In FIG. 5, indicated at $L_0$ is the length of a straight middle portion of the center core 11, at $L_1$ and $L_2$ are the respective lengths of tapered portions of the center core 11, at $S_0$ is the sectional area of the middle portion of the center core 11, and at $S_1$ and $S_2$ are the respective sectional areas of the high-tension end 111 and the low-tension end 112 of the center core 11. In this embodiment, $L_0:L_1:L_2=1:0.5:0.5$ and $S_0:S_1:S_2=1:0.3:0.3$.

The center core 11 is formed by superposing about 0.3 mm thick, flat, thin silicon steel sheets respectively having different widths and lengths so that the center core 11 has a substantially circular cross section. A recess is formed in one of the surfaces of each silicon steel sheet and a projection is formed in the other surface of the same, and the silicon steel sheets are superposed so that the projection of each silicon steel sheet is pressed in the recess of the adjacent silicon steel sheet. The space between the center core 11 and the secondary bobbin 14 is filled up with the elastic insulating material 13 to reduce stress in the edges of the component silicon steel sheets of the center core 11 and to reduce the intensity of an electric field around the edges of the silicon steel sheets of the center core 11. As shown in FIGS. 3 and 4, the center core 11 is surrounded by the secondary coil 15, the coil insulating material 20, the primary bobbin 16, the primary coil 17, the coil insulating material 20, the side core 21 and the coil case 19 in that order.

Figure 6:
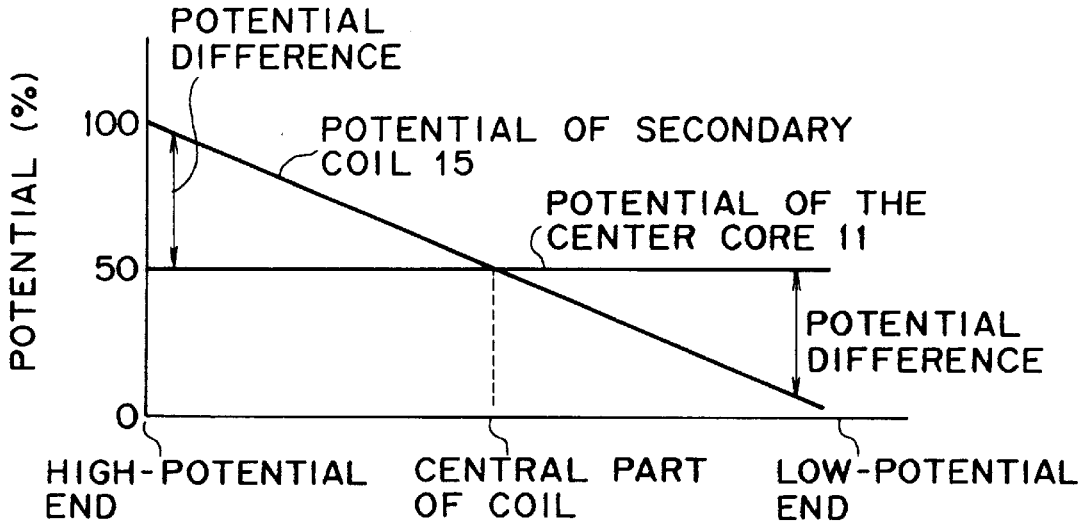
FIG. 6 is a diagrammatic view showing an axial potential distribution on the ignition coil 10 in the first embodiment according to the present invention.

FIG. 6 is a diagrammatic view showing an axial potential distribution in the space between the center core 11 and the secondary coil 15 of the ignition coil of a secondary coil system (system in which the center core 11 is surrounded by the secondary coil and the secondary coil is surrounded by the primary coil) shown in FIG. 1. Since the potential of the center core 11 is a floating potential, the intensity of the potential of the center core 11 is 50% of the maximum potential of the secondary coil as shown in FIG. 6. Therefore, the potential difference between the center core 11 and the secondary coil 15 increases to a maximum in portions near the high-tension side secondary coil end 151 (the end on the side of the spark plug 3) and a low-tension side secondary coil end 152 (the end on the side of the igniter 18) and the concentration of the electric field is high in the same portions. Particularly, since the secondary coil binding part 151*a* is formed near the high-tension side secondary coil division 151, the concentration of the electric field is the highest near the secondary coil binding part 151*a*.

Figure 18:
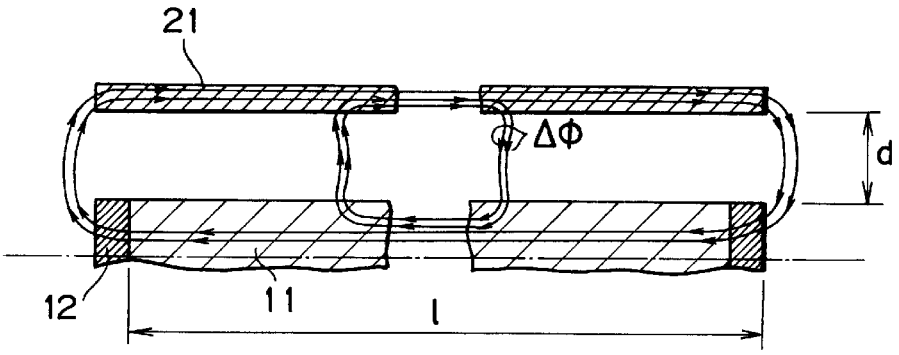
FIG. 18 is a view of assistance in explaining magnetic flux Φ in a magnetic circuit including a center core 11 in a comparative example, permanent magnets 12 and a side core 21.

FIG. 18 is a view of assistance in explaining magnetic flux $\Phi$ produced in an ignition coil when a primary current is supplied to a magnetic circuit including a center core 11 in a comparative example, permanent magnets 12 and a side core 21. Since the interval d between the center core 11 and the side core 21 is small as compared with the length l of the center core 11, the magnetic flux decreases by $\Delta\Phi$ in the vicinity of the opposite ends of the center core. Consequently, a magnetic flux density distribution on the center core 11 reaches a maximum in a middle portion of the center core 11 and decreases to a minimum at the opposite ends of the center core 11.

Figure 7:
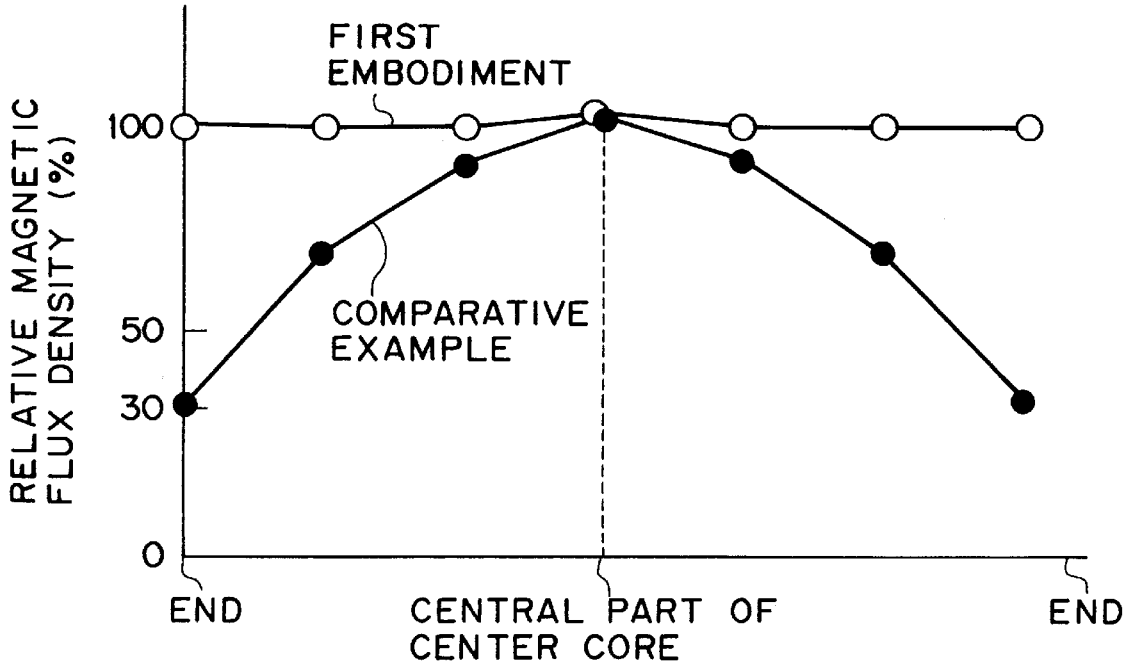
FIG. 7 is a graph showing axial magnetic flux density distributions on a center core 11 in the first embodiment and an ignition coil in a comparative example.

FIG. 7 shows measured axial magnetic flux density distributions on the center core of the first embodiment and on the center core of the comparative example. The sectional area of the center core 11 of the comparative example is constant with respect to the axial direction. In the ignition coil in the comparative example, the magnetic flux densities at the opposite ends 111 and 112 of the center core 11 are about 30% of that at the middle of the center core 11. Therefore, if the sectional area of the end portion of the center core is not less than about 30% of the sectional area of the middle of the center core, the magnetic characteristic of the ignition coil is not lower than that of the comparative example, which can be understood from a fact that the magnetic flux densities at the opposite ends and the middle portion of the center core are substantially the same the first embodiment, in which the sectional area of the end portions of the center core is 30% of the maximum sectional area of the middle portion of the center core. Magnetic loss in the ignition coil includes core loss resulting from eddy current loss caused by eddy currents produced in the surface of the core. In the first embodiment, end portions of the center core have a stepped shape. Therefore, the insulating resistance of the surface of the core against the eddy current is high and hence core loss is small and temperature rising of the ignition coil can be suppressed.

The sectional area of the center core 11 of the ignition coil in the first embodiment for an internal-combustion engine is a maximum in a middle portion of the center core 11 and decreases toward the opposite ends. Therefore, the amount of a material forming the center core is small, and an increased insulation distance can be secured in the vicinity of the permanent magnets 12 and the center core 11. Since the insulation distance between the center core 11 forming a high potential difference part and the secondary coil 15 is long, partial discharge detrimental to insulation can be suppressed. Since the end portions of the center core are tapered and are surrounded by the elastic insulating material 13, the intensity of thermal stress concentration on the end portions of the center core can be reduced, the electrical insulation of the center core and the secondary coil from each other can satisfactorily be achieved, the durability of the electrical insulation of the ignition coil can be improved and the reliability of the internal-combustion engine can be enhanced.

Second Embodiment

Figure 8:
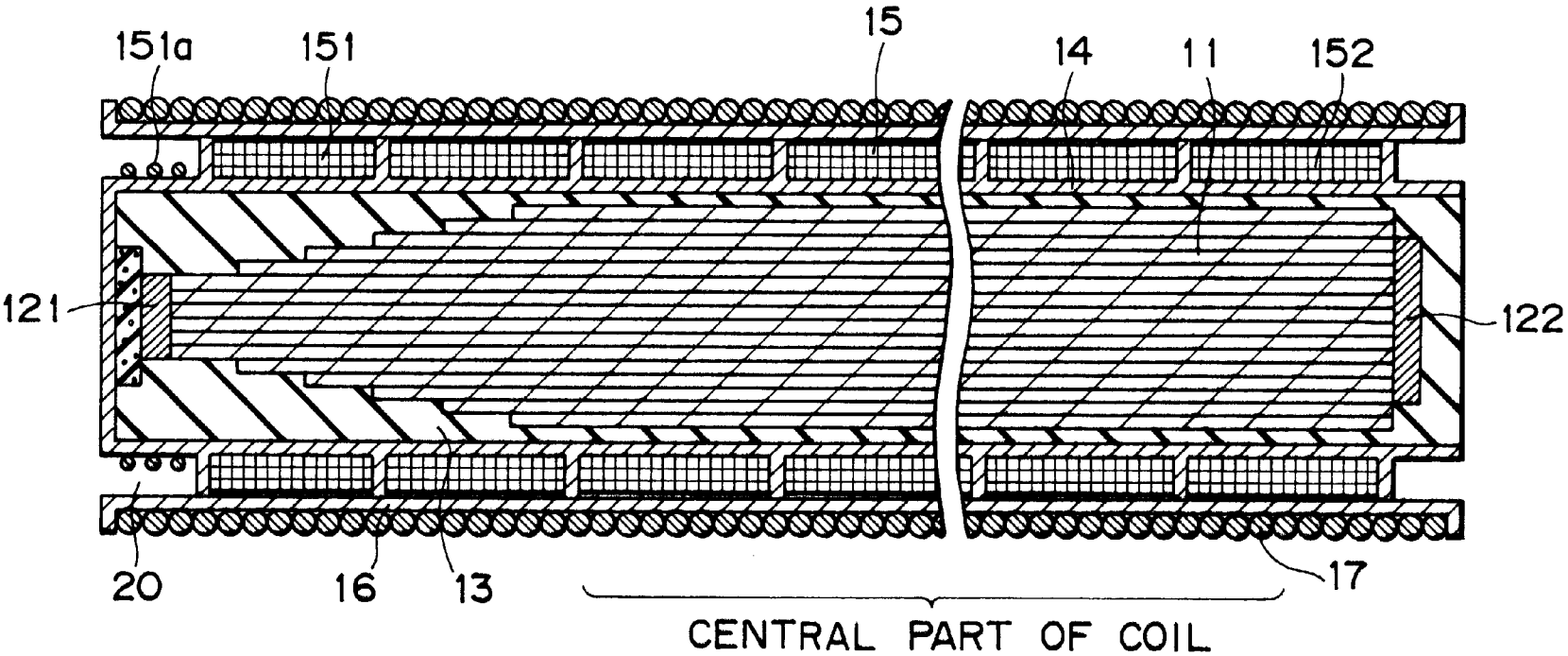
FIG. 8 is a longitudinal sectional view of an ignition coil 10 in a second embodiment according to the present invention for an internal-combustion engine.

An ignition coil in a second embodiment according to the present invention for an internal-combustion engine will be described. FIG. 8 is an enlarged longitudinal sectional view of a portion of the ignition coil in the second embodiment around a center core 11 and a secondary coil 15 corresponding to FIG. 5. The center core 11 of the ignition coil in the second embodiment has only a tapered end portion on the side of a high-tension side secondary coil end 151. Preferably, permanent magnets 121 and 122 respectively having sectional areas respectively corresponding to the respective areas of the opposite ends of the center core 11 are disposed on the opposite ends of the center core 11, respectively.

In the second embodiment, a long insulation distance can be secured around the end of the center core 11 on the side of the high-tension side secondary coil end 151 having the largest electric field concentarion. Therefore, the center core 11 and a secondary coil 15 can satisfactorily electrically insulated from each other and the electrical insulation capacity of the ignition coil can be improved. Since the permanent magnet 121 having a small sectional area is disposed on the small end of the center core having a small area on the high-tension side and the permanent magnet. 122 having a large sectional area is disposed on the large end of the center core having a large area on the low-tension side, magnetic flux density in the center core 11 is uniform and the center core 11 can efficiently store magnetic energy.

Third Embodiment

Figure 16:
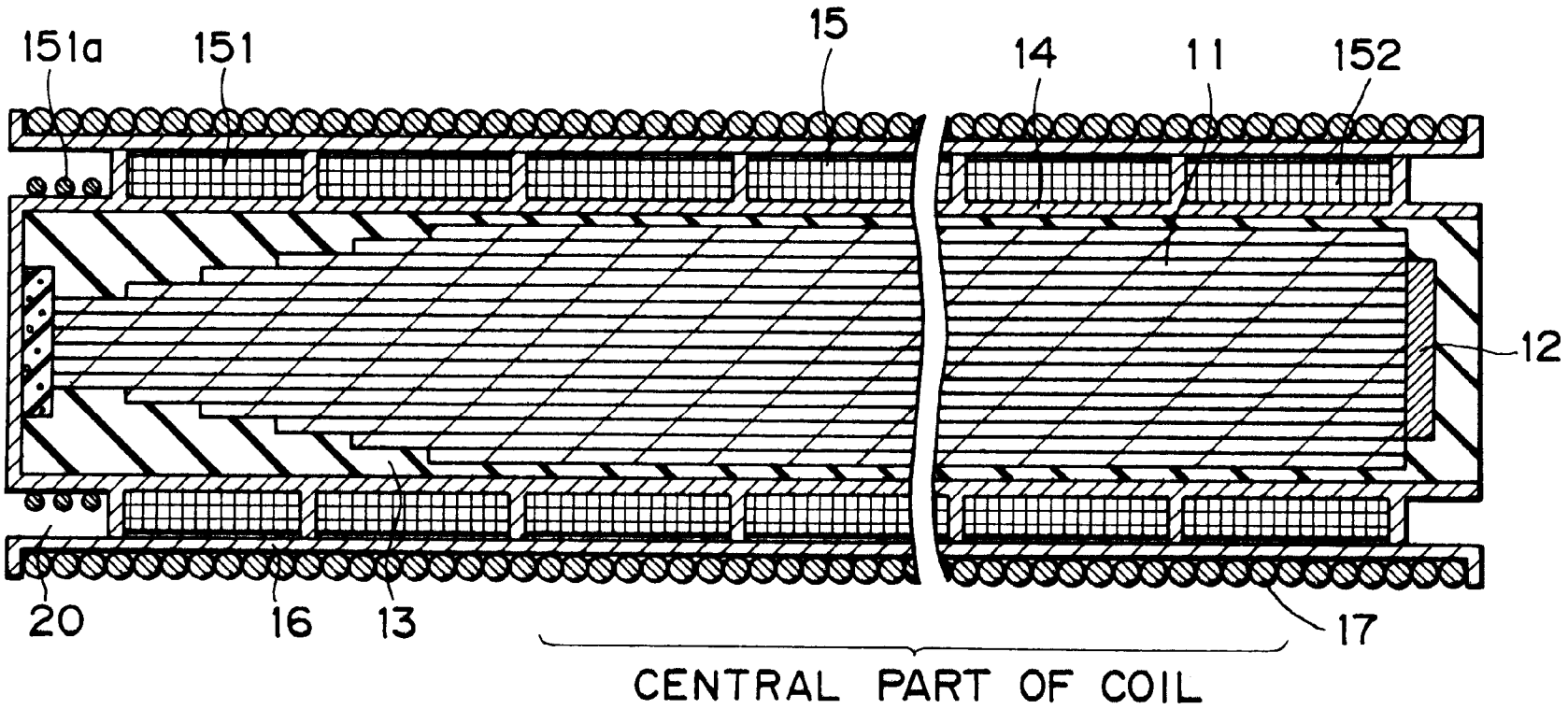
FIG. 16 is an enlarged longitudinal sectional view of a portion of an ignition coil embodying the present invention including a center core 11 and a secondary coil 15.

An ignition coil in a third embodiment according to the present invention for an internal-combustion engine will be described. FIG. 16 is an enlarged longitudinal sectional view of a portion of the ignition coil in the third embodiment around a center core 11 and a secondary coil 15 corresponding to FIGS. 5 and 8. The center core 11 of the ignition coil in the third embodiment is similar to that shown in FIG. 8, and only one permanent magnet 12 is disposed on a large end of the center core 11 on the side of a low-tension secondary coil end.

Since the permanent magnet 12 is disposed on the large end of the center core 11, magnetic flux density in the center core 11 is uniform and the effect of the permanent magnet can efficiently maintained without adversely affecting the effect of the electrical insulation.

Modification of the Third Embodiment

Figure 9:
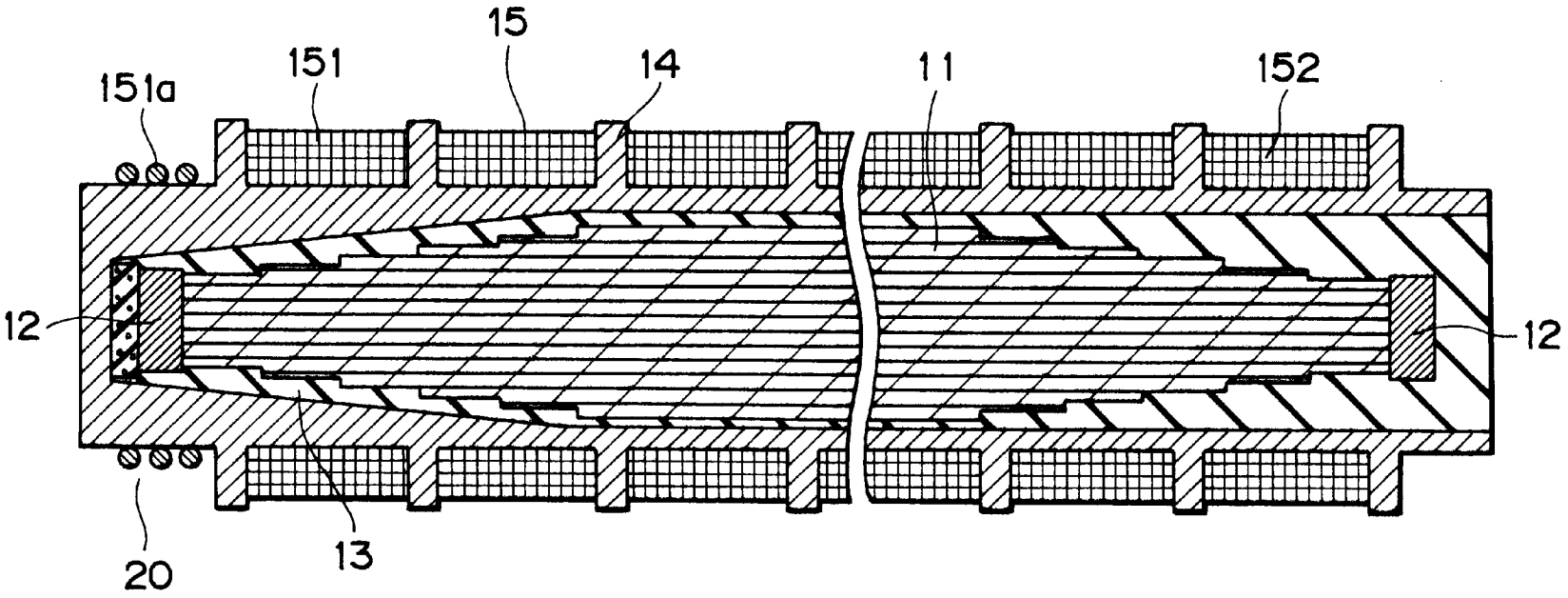
FIG. 9 is a longitudinal sectional view of an ignition coil 10 in a third embodiment according to the present invention for an internal-combustion engine.

An ignition coil in a modification of the third embodiment for an internal-combustion engine will be described. FIG. 9 is an enlarged longitudinal sectional view of a portion of the ignition coil in the modification of the third embodiment around a center core 11 and a secondary coil 15 corresponding to FIG. 5. The inner surface of a portion of a secondary bobbin 14 corresponding to a tapered end portion of the center core 11 on the side of a high-tension secondary coil end is tapered and a portion of the secondary bobbin 14 having the tapered inner surface has increased wall thickness.

Since a long insulation distance can be secured between the end portion of the center core 11 on the side of the high-tension secondary coil end and the secondary coil 15, and the secondary bobbin 14 having a withstand voltage higher than that of the elastic insulating material 13 is formed in a big thickness, the center core 11 and the secondary coil 15 can more satisfactorily electrically insulated from each other and the electrical insulation capacity of the ignition coil can be improved.

Fourth Embodiment

Figure 10:
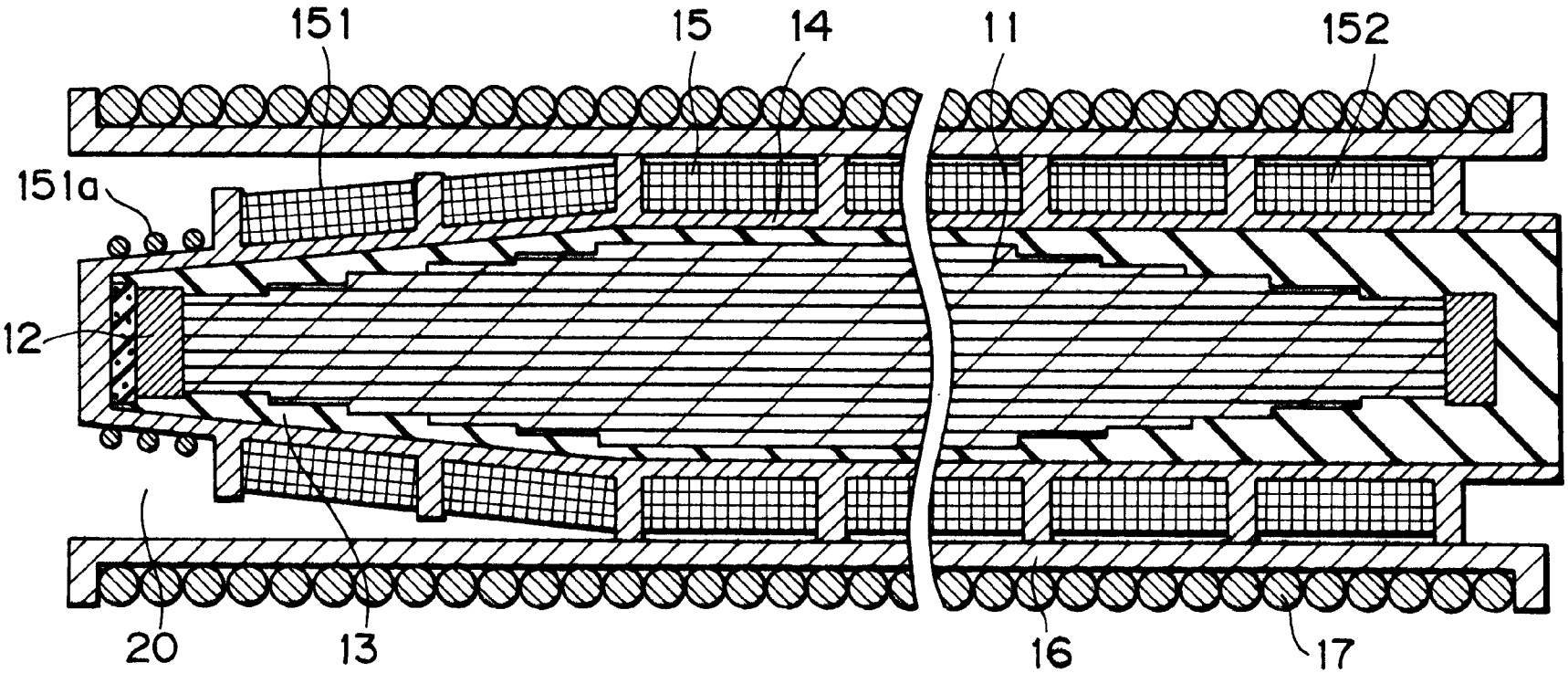
FIG. 10 is a longitudinal sectional view of an ignition coil 10 in a fourth embodiment according to the present invention for an internal-combustion engine.

An ignition coil in a fourth embodiment according to the present invention for an internal-combustion engine will be described. FIG. 10 is an enlarged longitudinal sectional view of a portion of the ignition coil in the fourth embodiment around a center core 11 and a secondary coil 15 corresponding to FIG. 5. A portion of a secondary bobbin 14 corresponding to a tapered end portion of the center core 11 on the side of a high-tension secondary coil end 151 is tapered without varying its wall thickness to increase the insulation distance of a coil insulating material 20 filling up a space between a portion of a secondary coil 14 on the side of the high-tension secondary coil end 151 and a corresponding portion of a primary coil 17.

Since the thickness of the insulating material 20 filling up the space between the portion of the secondary coil 14 on the side of the high-tension secondary coil end 151 and the portion of the primary coil 17 can be increased, electrical insulation capacity can be improved.

Fifth Embodiment

Figure 11:
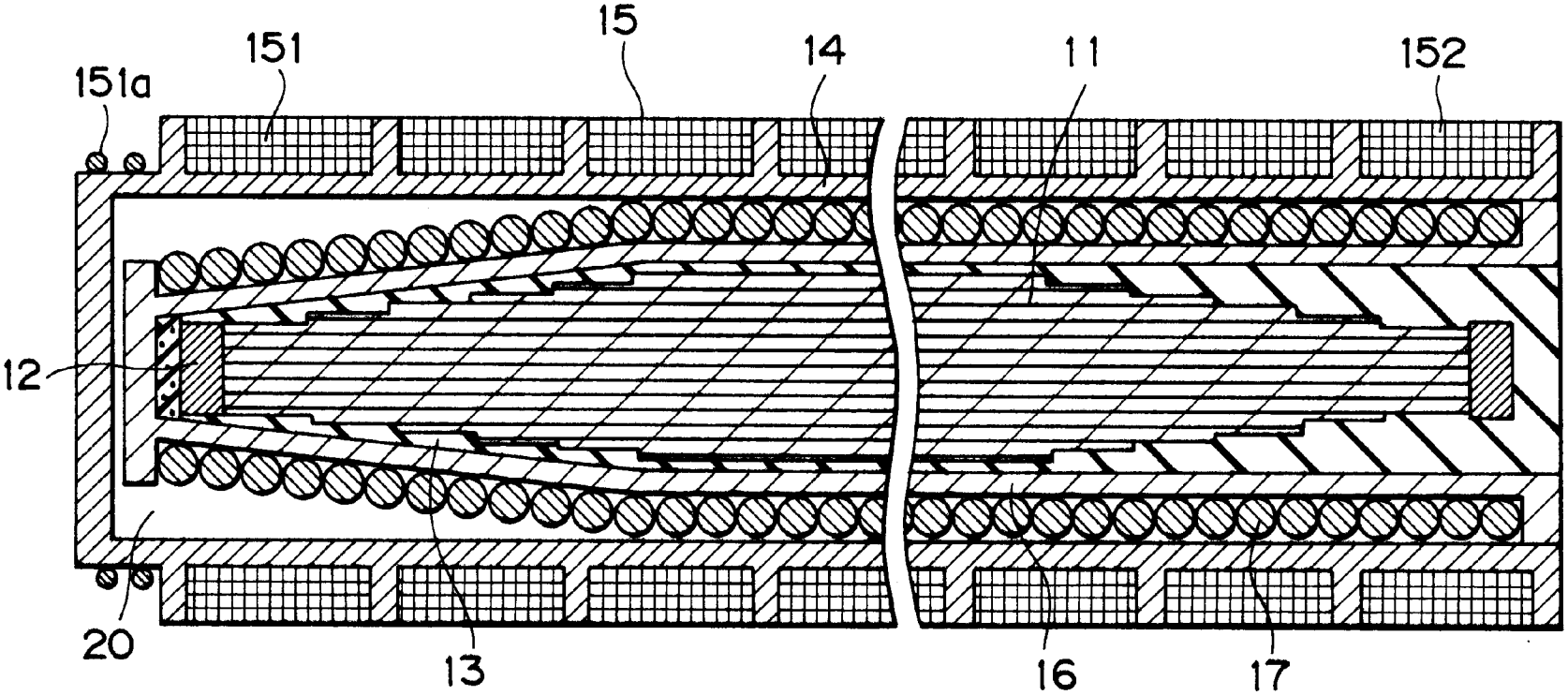
FIG. 11 is a longitudinal sectional view of an ignition coil 10 in a fifth embodiment according to the present invention for an internal-combustion engine.

An ignition coil in a fifth embodiment according to the present invention for an internal-combustion engine will be described. FIG. 11 is an enlarged longitudinal sectional view of a portion of the ignition coil in the fifth embodiment around a center core 11 and a secondary coil 15. The ignition coil in the fifth embodiment is of an inner primary coil system in which the center core 11 is surrounded by a primary coil 17, and the primary coil 17 is surrounded by the secondary coil 15. The center core 11 is at a floating potential, or is grounded or substantially grounded. In the fifth embodiment, the center core 11 is grounded or substantially grounded.

Figure 17:
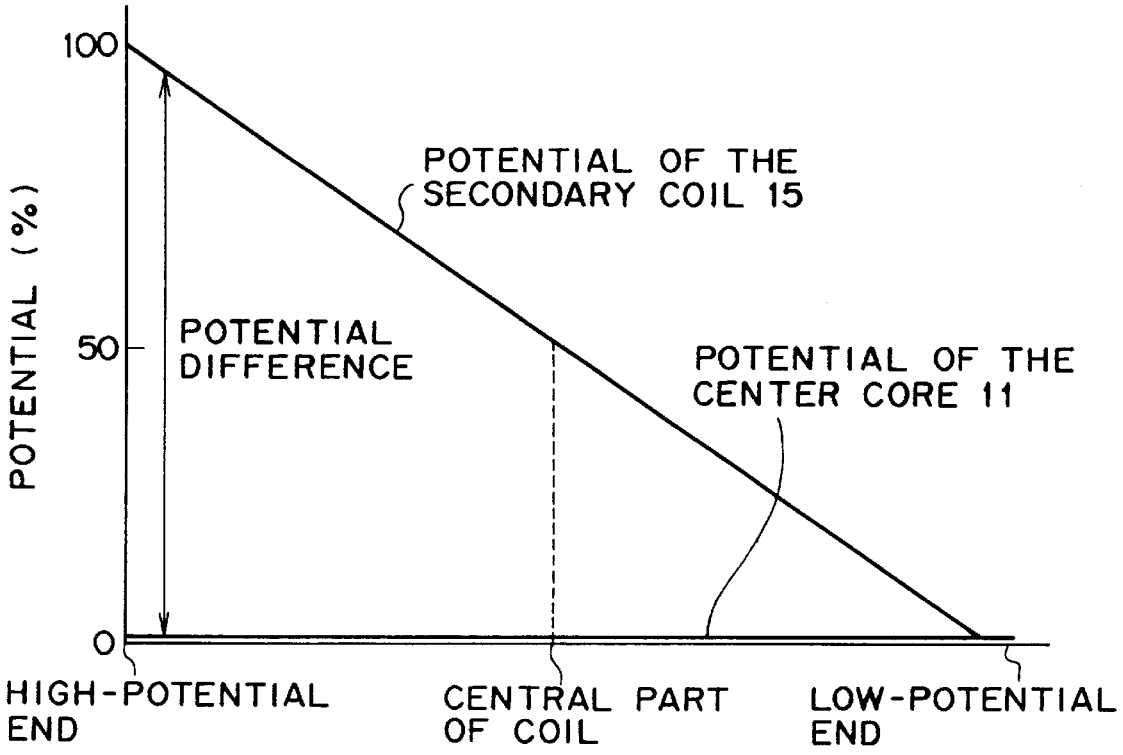
FIG. 17 is a graph showing a potential distribution in the fifth embodiment of the present invention.

FIG. 17 is a diagram corresponding to that of FIG. 6 and showing a potential distribution in the secondary coil 15 of the fifth embodiment. A maximum potential difference appears in an end on the high-tension side. The maximum potential difference is twice as large as that when the center core is at a floating potential. The potential difference at an end on the low-potential side is substantially naught.

Since the ignition coil of an inner primary coil system has the secondary coil 15 surrounding the primary coil 17, high electric field concentration occurs in a space between a portion of the center core on the side of a high-tension secondary coil end 151 and the primary coil 17. Since a long insulation distance can be secured between the portion of the center core on the side of the high-tension secondary coil end 151 and the primary coil 17, the corresponding portion of the ignition coil has a high withstand voltage, detrimental partial discharge can be suppressed and electrical insulation capacity can be improved.

Sixth Embodiment

Figure 12:
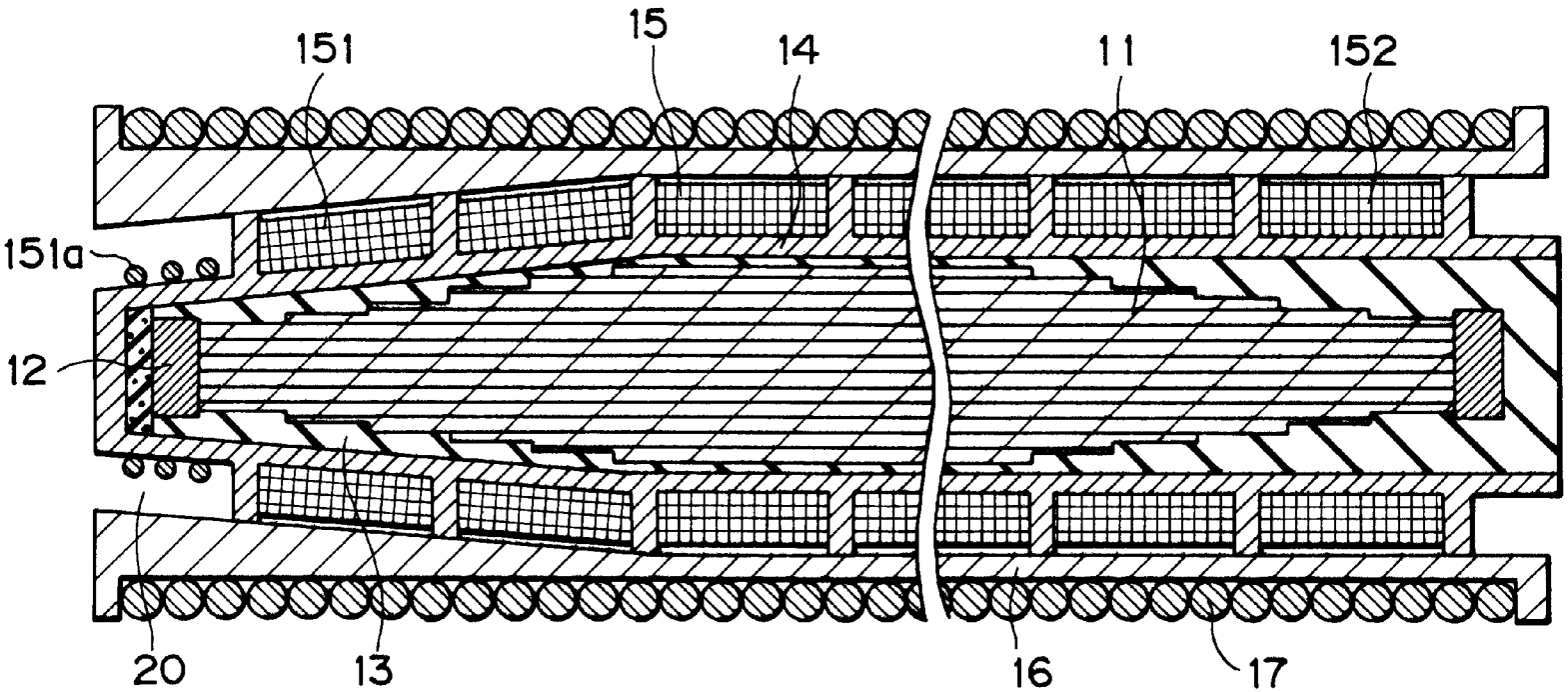
FIG. 12 is a longitudinal sectional view of an ignition coil 10 in a sixth embodiment according to the present invention for an internal-combustion engine.

An ignition coil in a sixth embodiment according to the present invention for an internal-combustion engine will be described. FIG. 12 is an enlarged longitudinal sectional view of a portion of the ignition coil in the sixth embodiment around a center core 11 and a secondary coil 15. The ignition coil in the sixth embodiment is of an inner secondary coil system. In the ignition coil in the sixth embodiment, a secondary bobbin 14 has a uniform wall thickness. An end portion of the secondary bobbin 14 on the side of a high-potential end is tapered, the inner surface of an end portion of a primary bobbin 16 on the side of the high-potential end corresponding to the tapered end portion of the secondary bobbin 14 is tapered toward the end so that the thickness of the end portion of the primary bobbin 16 increases toward the end and a long insulation distance can be secured between an end portion of the secondary coil 15 on the side of a high-potential secondary coil end 151 and the corresponding end portion of the primary coil 17. The ignition coil in the sixth embodiment, similarly to the ignition coil in the fourth embodiment, has improved electrical insulation capacity for electrically insulating the portion of the secondary coil in the vicinity of the high-potential secondary coil end 151 and the primary coil 17 from each other.

Preferably, the area of the opposite ends of the center core 11 is in the range of 30% (a minimum area) to 95% (a maximum area) of the maximum sectional area of the center core 11. The minimum area is limited by the magnetic flux density distribution in the first embodiment. If the area of the opposite ends of the center core 11 is less than 30% of the maximum sectional area, the discharge energy of the ignition coil will be lower than that of the comparative example. The maximum area is related with the insulation capacity. Insulation distance from the end of the center core 11 increases when the area of the end surface of the center core 11 is reduced. Since the maximum outside diameter of the center core 11 is about 10 mm and the thickness of the component silicon steel sheets of the center core 11 is 0.3 mm, taking processability of the center core into consideration an appropriate maximum area of the opposite ends of the center core 11 is equal to the sectional area of a section of a diameter smaller by 0.3 mm than the maximum diameter of the center core 11, i.e., 95% of the maximum sectional area of the center core Although it is preferable that the area of the opposite ends of the center core 11 be in the foregoing range, a more preferable area is dependent on the length Lo of the flat portion shown in FIG. 5. As mentioned above, the center core 11 is formed by fixedly superposing the flat portions of the component sheets. The adjacent component sheets must be fastened together at least at two positions on the flat portions to hold the component sheets fixedly in place relative to each other. Therefore, the length $L_0$ of the flat portions must be about 20 mm or above.

Figure 13:
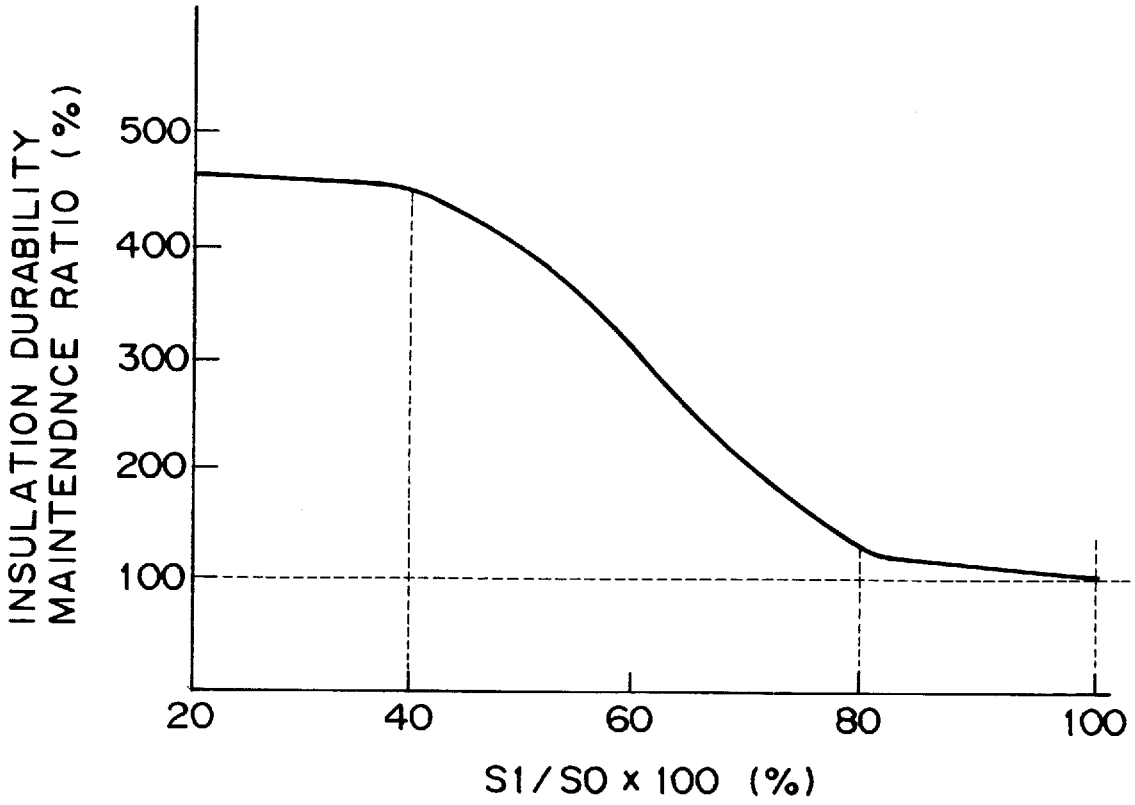
FIG. 13 is a graph showing the insulation durability of the ignition coil in the first embodiment.

FIG. 13 is a graph showing the insulation durability of ignition coils of construction shown in FIG. 5 having the length $L_0$=20 mm, end surfaces of the same area ($S_1$=$S_2$) and differing from each other in the ratio $S_1/S_0 \times 100$ (%). In FIG. 13, insulation durability is represented by insulation durability life maintenance ratio (%). The sectional area of the permanent magnet 12 disposed on the end of the center core 11 is approximately equal to the area of the same end of the center core 11, and the secondary bobbin 14 is 1 mm in wall thickness. In the graph shown in FIG. 13, the ratio $S_1/S_0 \times 100$ (%) is measured on the horizontal axis, and the insulation durability life maintenance ratio (%) is measured on the vertical axis. Time for which the ignition coil having the ratio $S_1/S_0 \times 100\%$ operated before breakdown when the ignition coil was used in an atmosphere of 140° C. at a secondary voltage $V_2$ of 25 kV is insulation durability life of 100%. It is known from FIG. 13 that the insulation durability increases when the ratio $S_1/S_0$ increases from about 80% to about 40%. The electric field relaxation effect of the end portions of the center core is insignificant when ratio $S_1/S_0$ is about 80% or above. Breakdown occurs in the flat portion of the center core 11 when ratio $S_1/S_0$ is about 40% or below. It is known from the measured insulation durability that it is preferable that the length $L_0$ is 20 mm or above and the area of the end surfaces of the center core 11 is in the range of 40% to 80% of the maximum sectional area.

It is preferable that the sectional area of the permanent magnet 12 be greater than the area of the end surface of the center core in view of preventing the reduction of discharge energy, and it is preferable that the sectional area of the permanent magnet 12 be smaller than the maximum sectional area of the center core from the viewpoint of insulation capacity. Therefore, it is preferable that the sectional area of the permanent magnet 12 be greater than the area of the end surface of the center core and smaller than the maximum sectional area of the center core.

As mentioned above, electric field concentration can be reduced without reducing discharge energy by tapering the end portion of the center core 11, particularly, the end portion on the high-tension side, toward the end. Therefore, the center core and the secondary coil, and the secondary coil and the primary coil can satisfactorily be insulated from each other, so that the electrical insulation durability of the ignition coil can be improved, the reliability of the internal-combustion engine can be enhanced. Temperature rising of the ignition coil can be suppressed through the reduction of core loss.

Seventh Embodiment

Figure 15:
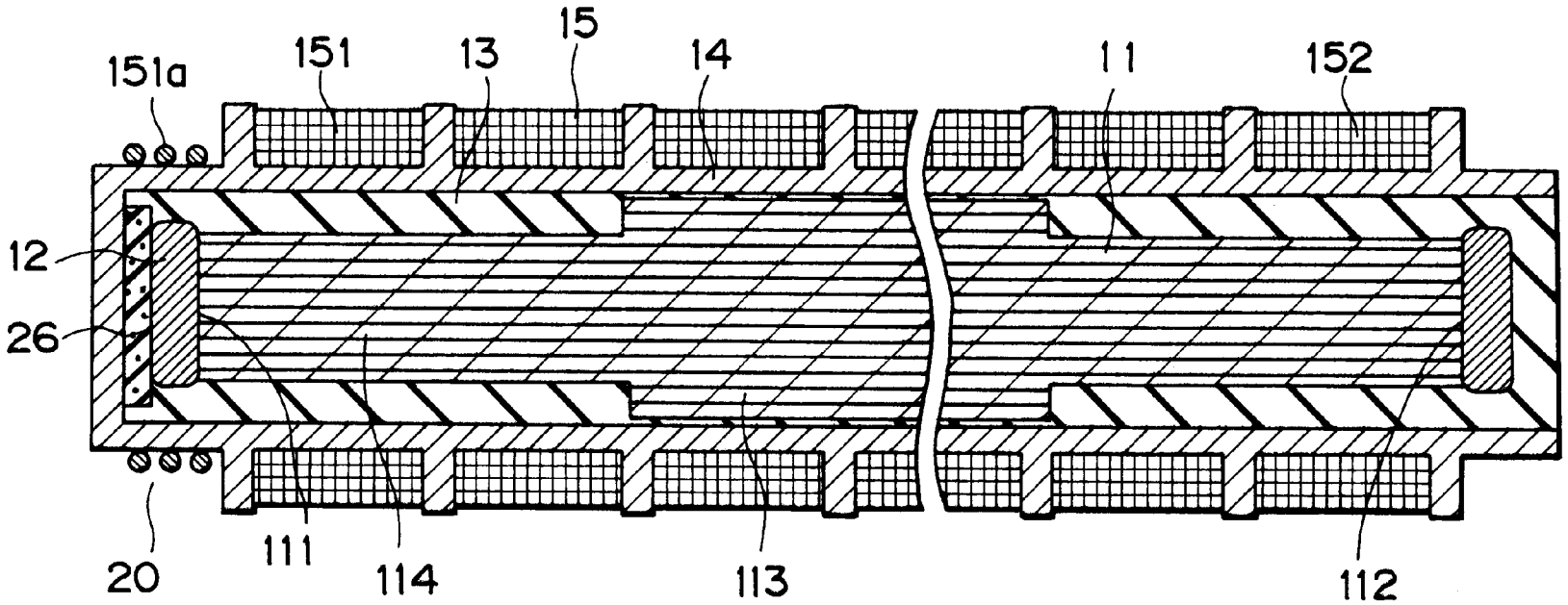
FIG. 15 is an enlarged longitudinal sectional view of an ignition coil 10 in a seventh embodiment according to the present invention for an internal-combustion engine.

An ignition coil in a seventh embodiment according to the present invention for an internal-combustion engine will be described with reference to FIG. 15. FIG. 15 is an enlarged longitudinal sectional view of a portion of the ignition coil in the sixth embodiment around a center core 11 and a secondary coil 15. This ignition coil has a center core 11 having a relatively short middle portion 113 having a relatively big diameter, and relatively long end portions 114 having a relatively small diameter and extending in opposite directions, respectively, from the middle portion 113. Therefore, the middle portion 113 of the center core 11 has a sectional area greater than those of the ends of the end portions 114 on the side of a low-potential end 112 and the high-potential end 111.

The magnetic characteristic of the magnetic circuit of the seventh embodiment is inferior to that of the magnetic circuit of the first embodiment. However, the seventh embodiment is able to secure a long insulation distance in the high-potential difference part and have improved electrical insulation capacity.

The present invention secures discharge energy for an ignition coil and provides an internal-combustion engine an d an ignition coil for an internal-combustion engine having satisfactory electrical insulation capacity.

What is claimed is:

1. An ignition coil for an internal-combustion engine, comprising:

a primary bobbin on which a primary coil is wound;

a secondary bobbin on which a secondary coil is wound; and a center core;

wherein an area of a cross section of the center core perpendicular to an axis of the coils at a position on the inner side of opposite ends of the center core is a maximum.

2. The ignition coil for an internal-combustion engine, according to claim 1, wherein the sectional area of the end of the center core smaller than the sectional area of the maximum sectional area of the center core is in the range of 30% to 95% of the maximum sectional area of the center core.

3. The ignition coil according to claim 1, wherein length $L_0$ of the flat portion having the maximum sectional area of the center core is 20 mm or greater, and the sectional area of the smaller end of the center core is in the range of 40% to 80% of the maximum sectional area of the center core.

4. The ignition coil for an internal-combustion engine according to claim 1, wherein ends of the center core have a substantially circular shape.

5. An internal-combustion engine using an ignition coil for an internal-combustion engine described in claim 1.

6. An ignition coil for an internal-combustion engine, comprising:

a primary bobbin on which a primary coil is wound;

a secondary bobbin on which a secondary coil is wound; and a center core;

wherein a cross section of the center core at the middle of the center core has a maximum sectional area, and the sectional area of at least one of the opposite ends of the center core is smaller than that of the cross section at the middle of the center core perpendicular to an axis of the coils.

7. An ignition coil for an internal-combustion engine, comprising:

a center core; and permanent magnets disposed on the opposite ends of the center core, respectively;

wherein the sectional areas of the permanent magnets are greater than the cross sectional area of the opposite ends of the center-core, and smaller than the maximum sectional area of the center core.

8. An ignition coil for an internal-combustion engine, comprising:

a primary bobbin on which a primary coil is wound;

a secondary bobbin on which a secondary coil is wound; and a center core;

wherein the diameter of the center core is decreased stepwise from a middle portion toward the ends of the center core.

* * * * *